United States Patent [19]

Walker

[11] Patent Number: 4,993,675

[45] Date of Patent: Feb. 19, 1991

[54] CAN CADDY

[76] Inventor: Joe Walker, 209 S. Gardenia, Toppenish, Wash. 98948

[21] Appl. No.: 438,613

[22] Filed: Nov. 17, 1989

[51] Int. Cl.[5] ..... B65D 25/00

[52] U.S. Cl. ..... 248/311.2; 220/85 H; 220/94 R

[58] Field of Search ..... 248/311.2, 312, 312.1, 248/154, 314; 220/85 H, 94 R

[56] References Cited

U.S. PATENT DOCUMENTS

| | | | |
|---|---|---|---|
| 2,128,466 | 8/1938 | Machotka | 220/85 H X |
| 2,784,578 | 3/1957 | Southwick | 65/61 |
| 2,801,743 | 8/1957 | Geen | 206/65 |
| 2,813,742 | 11/1957 | Neugebauer | 294/32 |
| 2,896,812 | 7/1959 | Paprocki | 220/85 |
| 3,029,975 | 4/1962 | Aiello | 220/85 |
| 3,074,678 | 1/1963 | Mele | 248/145.6 |
| 3,076,223 | 2/1963 | Reichold | 16/114 |
| 3,107,028 | 10/1963 | Robertis | 220/85 H X |
| 3,261,635 | 7/1966 | Talay | 294/29 |
| 3,458,164 | 7/1969 | Massey | 248/145.6 |
| 3,825,151 | 7/1974 | Arnaud | 220/85 H X |
| 4,552,276 | 11/1985 | Buch | 220/85 H X |
| 4,602,723 | 7/1986 | DeMars | 220/94 R X |
| 4,654,274 | 3/1987 | DeMars | 248/311.2 X |
| 4,726,470 | 2/1988 | Lieberman | 220/85 H X |
| 4,791,030 | 12/1988 | DeMars | 248/311.2 X |
| 4,817,810 | 4/1989 | Shull | 220/94 R X |

*Primary Examiner*—David M. Purol

*Attorney, Agent, or Firm*—George A. Cashman

[57] ABSTRACT

A one-piece can caddy, or holder, for a beverage can has a base support structure approximating the shape of the bottom of a beverage can, a wall extending upward from a portion of the periphery of the base support structure, a handle extending radially outwardly from the wall, and a resilient can retaining clip diverging from the top of the handle and extending radially inwardly to overlie the top bead of the can and retain the can on the base support structure.

2 Claims, 1 Drawing Sheet

FIG. 1

CAN CADDY

BACKGROUND OF THE INVENTION

1. Field of the Invention

As is well known, and as has been described in some of the references, when people drink refrigerated carbonated beverages and beer from cans, the cold outer surface of the can "sweats", or becomes wet because of condensation of moisture from the ambient air. Further, people like their beverages to be cold and, when the can is held in the fingers, heat is transferred from the fingers to the contents of the can, and the contents warm up faster than otherwise would be the case. In addition, brewers and soft drink canners desire to advertise their wares at every reasonable opportunity. For these reasons, it is desirable to provide an article which can be easily, quickly and securely applied to a can, and which will permit a person to drink directly from the can without actually touching it, thereby keeping the person's hand dry, and avoiding undue warming of the contents. Preferably, the article should be so structured that there is room for display of a commercial logo of a reasonable size. The article should be made of a single piece of plastic for light weight and cheap manufacture. This invention meets those requirements.

2. Description of the Related Art

Southwick (U.S. Pat. No. 2,784,578) discloses a wooden can holder with a coaster bottom provided with a moisture-absorbing pad. The holding means comprises a pair of arms extending circularly outward from the handle. This is apparently intended to hold steel cans, because today s thin aluminum cans would probably deform if one tried to snap a can into the arms of Southwick.

Geen (U.S. Pat. No. 2,801,743) features, in the relevant embodiment, a coaster bottom. A flexible handle extends upward from the coaster, and there is a small hook extending downward from the free end of the handle to engage the upper can bead. The handle is made of wood, and the dimensions of the handle which provide flexibility are described in considerable detail.

Neugebauer (U.S. Pat. No. 2,813,742) is a can holder designed for cans having a bead at each end. A metal leaf spring attached to the inner side of the metal handle urges the can toward a lip above the coaster floor, where the lower bead will be retained. A strap is provided for releasing the spring. It is doubtful if this holder could be used with today's aluminum cans because of the required spring action on the wall of the can.

Paprocki (U.S. Pat. No. 2,896,812) is a can holder designed for cans having a bead at each end. There are several pieces, including the coaster, a resilient handle, and a pivoting cover like a German beer stein. The free end of the handle is fitted with a flange for retention of the upper bead of the can.

Aiello (U.S. Pat. No. 3,029,975) discloses a flexible can handle similar in operation to Geen. It is designed for a double-beaded can, and has a circularly-grooved coaster extending from the lower end of the handle, and a circularly-grooved sector extending from the upper end of the handle. The handle utilizes ribs as stiffeners.

Mele (U.S. Pat. No. 3,074,678) discloses a cylindrical holder cup with a resilient handle forming, in effect, a large hook, where the downward pointing free end of the handle engages inside the upper bead of the can. The can is held in the cup by means of an inward bend near the lower end of the handle, which engages the side wall of the can and urges the can against the cup wall. Again, this does not look suitable for thin-walled aluminum cans. Reichold (U.S. Pat. No. 3,076,223) discloses a detachable handle for blender jars. The handle can accommodate different heights of jars, and is operated by rotating the handle to clamp it in place and to remove it from the jar.

Talay (U.S. Pat. No. 3,261,635) is a beer can handle designed for double-beaded cans. A spring latch is located on top of the handle and extends over the upper can bead.

Massey (U.S. Pat. No. 3,458,164) is a three-piece can holder utilizing arms as a holding means, similar to Southwick. The can is supposed to be snapped into place, and the arms hold the can in a "tight gripping relationship". Again, this was probably intended for steel cans.

BRIEF SUMMARY OF THE INVENTION

The can caddy, or can holder, of this invention is of a single piece designed for low-cost manufacture with almost all sections of the same thickness. The circular base has an indentation in its top surface designed to receive the bottom of a soft drink can or a beer can. A curved wall extends upward from a portion of the periphery of the base. A handle, having its vertical inner side formed to accommodate the fingers, extends outwardly from the wall. The upper horizontal portion of the handle diverges, with a resilient can-holding clip extending radially inward. A detent extends downward from the inner end of the clip, and overlies the place where the bead at the upper end of a can would be placed. The clip is knurled at its end, and is flexible. A can may be placed in the circular bottom, and snapped in place under the clip. Alternatively, the top of the can may first be placed in contact with the clip, and the bottom of the can then moved into position on the base. The can is held snugly by the downward force exerted by the resilient clip, and can be easily removed either by raising the clip, or tilting the can outwards from the bottom.

DETAILED DESCRIPTION OF THE INVENTION

Figure 1:
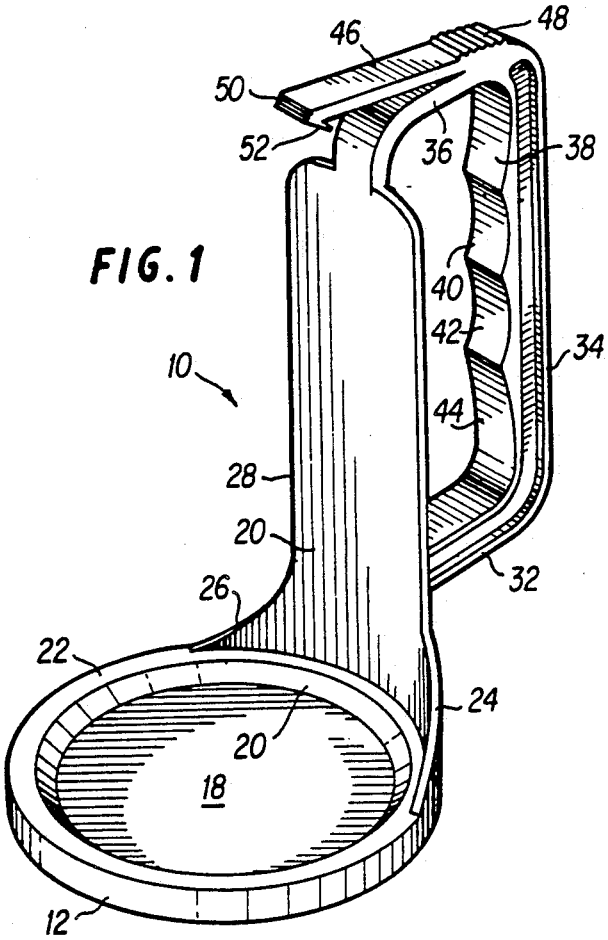
FIG. 1 is a perspective view of the can caddy of this invention.

The can caddy or can holder 10 of this invention is made of plastic, and is molded in one piece. A circular base 12, see FIGS. 1, 2 and 3, has flat bottom 14 on which can caddy 10 stands. Bottom 14 slopes outward and upward at its periphery, and terminates in downturned circular ridge 16. Bottom 14 and the bottom edge of circular ridge 16 lie in the same plane. Flat circular receptacle area 18 is formed on the upper side of base 12. The diameter of receptacle area 18 is slightly larger than the bottommost circular portion of a soft drink can or beer can. Receptacle area 18 is surrounded by ramp 19 which extends upwardly and outwardly therefrom.

Figure 2:
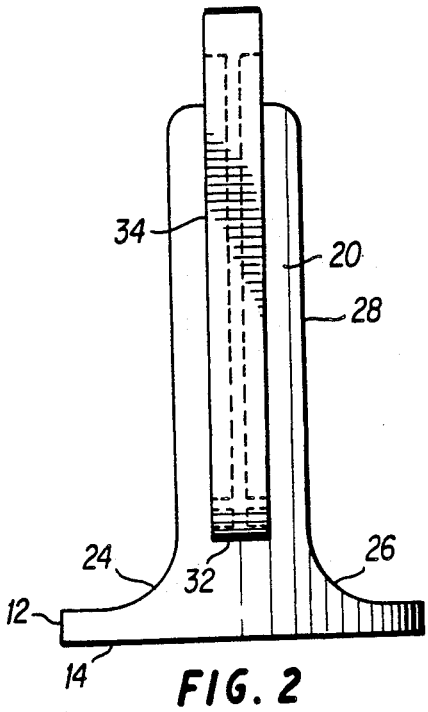
FIG. 2 is an elevational view from the side of the caddy having the handle.
Figure 3:
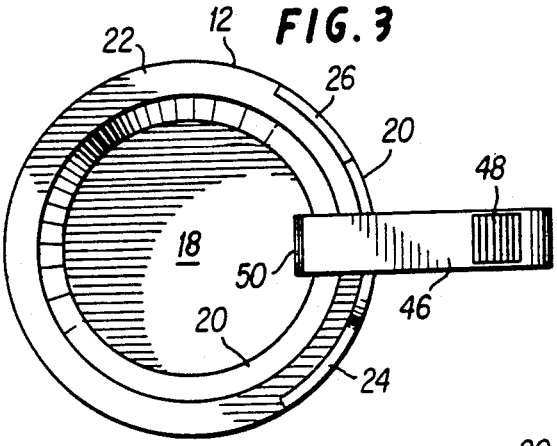
FIG. 3 is a plan view of the can caddy.

Wall 20 extends upward from the periphery of outer ring 22 of caddy 10. Ridge 16 and outer ring 22 together provide stiffening structural support for bottom 14, including the upward and outward sloped segment thereof. Where wall 20 meets outer ring 22, wall 20 covers approximately one-third of the periphery of outer ring 22. Wall 20 has curved portions 24 and 26 which transition to a straight segment 28 of wall 20. As can be seen in FIGS. 1 and 3, wall 20 is curved to accommodate the shape of the wall of a soft drink can or a beer can.

Figure 4:
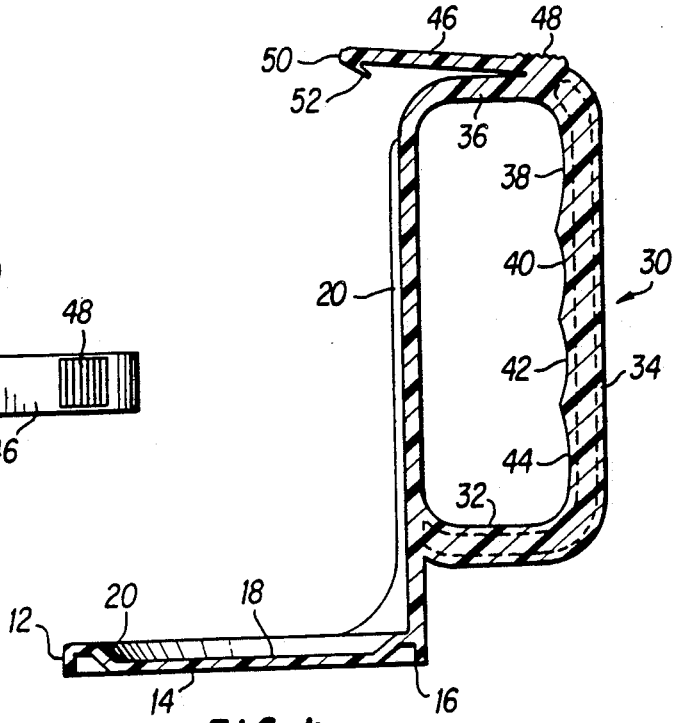
FIG. 4 is a sectional view taken at line 4—4 of FIG. 3.
Figure 5:
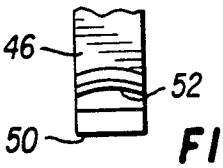
FIG. 5 is a partial view of the can retaining clip as viewed from below.

Handle 30, having lower segment 32, grip section 34 and upper segment 36 extends outwardly from wall 20. Grip section 34 has finger segments 38, 40, 42 and 44 to accommodate the user's fingers. Can clip 46 diverges, and extends radially inwardly from upper segment 36 of handle 30. As can be seen in FIGS. 1, 3 and 4 can clip 46 is of sufficient cross-section to provide the proper combination of rigidity and flexibility so that clip 46 can be raised to insert or release a can, and yet exert sufficient downward force, when released, to retain a can in the caddy or holder. Upper segment 36 of handle 30 is knurled at 48 to permit a secure grip by the user's thumb. Can clip 46 terminates at its innermost part in knurled portion 50, to assist the user in raising detent 52 from the can bead, if need be. Detent 52 extends downward from the underside of the inner end of can clip 46. As can be seen in FIG. 5 detent 52 is curved to fit the inner portion of the bead of a soft drink can or a beer can.

As can be seen in FIG. 4, the construction of can caddy 10 is of an approximately uniform thickness throughout, with the exception of upper segment 36 of handle 30, from which can clip 46 extends.

Both front and back surfaces of wall 20 provide ample space for the display of a beverage maker's logo.

While this invention is susceptible of embodiment in different forms, the drawings and the specification illustrate the preferred embodiment of the invention, with the understanding that the present disclosure is to be considered an exemplification of the principles of the invention, and the disclosure is not intended to limit the invention to the particular embodiment described.

I claim:

1. A single-piece holder for releasably retaining a beverage can or the like comprising:

a can bottom support means;

a partially circular wall extending upwards form the periphery of the can bottom support means;

a handle extending radially outward from the wall; and a can retaining clip extending radially inward from the top of the handle, said clip comprising:

a resilient element diverging from the top portion of the handle, and extending radially inwardly a sufficient distance to overlie the top bead of a beverage can; and a curved detent extending downwardly from the inner end of the clip, the radius of the curve of the radially outward side of the detent being of approximately the same radius as the inner side of the top bead of a beverage can, the radially outward side of the detent being so located as to contact said inner side of the top bead.

2. The holder of claim 1 wherein the can bottom support means comprises;

a circular plate;

an upwardly and outwardly inclined ramp surrounding the circular plate, the ramp and the plate together approximating the shape of the bottom of a beverage can; and a stiffening ring surrounding the plate and the ramp.

* * * * *